US006729236B2

(12) United States Patent
Knabe et al.

(10) Patent No.: US 6,729,236 B2
(45) Date of Patent: May 4, 2004

(54) CLEANING DEVICE IN A PRINTING MACHINE AND PRINTING MACHINE WITH A CLEANING DEVICE

(75) Inventors: Alexander Knabe, Heidelberg (DE); Dieter Schaffrath, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/855,931

(22) Filed: May 15, 2001

(65) Prior Publication Data

US 2001/0039894 A1 Nov. 15, 2001

(30) Foreign Application Priority Data

May 15, 2000 (DE) ..... 100 23 829

(51) Int. Cl.[7] ..... B41L 41/00
(52) U.S. Cl. ..... 101/423; 101/425
(58) Field of Search ..... 101/423–425; 15/256.5, 256.51; 399/350, 351, 343

(56) References Cited

U.S. PATENT DOCUMENTS

| | | | | | |
|---|---|---|---|---|---|
| 3,043,215 | A | * | 7/1962 | Gates | 101/425 |
| 3,601,051 | A | * | 8/1971 | Gegenheimer | 101/425 |
| 4,254,709 | A | * | 3/1981 | Arnolds | 101/425 |
| 5,365,849 | A | * | 11/1994 | Spiegel | 101/424 |
| 5,622,112 | A | * | 4/1997 | Kusch et al. | 101/423 |
| 6,360,875 | B1 | * | 3/2002 | Altemus et al. | 198/499 |
| 6,361,655 | B1 | * | 3/2002 | Holopainen et al. | 101/169 |

FOREIGN PATENT DOCUMENTS

| | | |
|---|---|---|
| DE | 4328834 A1 | 3/1995 |
| DE | 4422612 C2 | 6/1995 |

* cited by examiner

*Primary Examiner*—Anthony H. Nguyen
(74) *Attorney, Agent, or Firm*—Laurence A. Greenberg; Werner H. Stemer; Ralph E. Locher

(57) ABSTRACT

A cleaning device in a printing machine includes a cleaning tool and a tilting clamp mechanism for holding the cleaning tool in different positions. The cleaning tool and the tilting clamp mechanism are coupled to, and can be decoupled from, each other by a coupling device. A printing machine having a cleaning device is also provided.

9 Claims, 4 Drawing Sheets

CLEANING DEVICE IN A PRINTING MACHINE AND PRINTING MACHINE WITH A CLEANING DEVICE

BACKGROUND OF THE INVENTION

FIELD OF THE INVENTION

The invention relates in a printing machine having a cleaning tool and a tilting clamp mechanism (or tilting over-center-mechanism) for holding the cleaning tool in different positions. The invention also relates to a printing machine having a cleaning device.

German Patent DE 44 22 612 C1, corresponding to U.S. Pat. No. 5,622,112, teaches a cleaning device of that type, having tilting clamp mechanisms which are referred to in the reference as knee lever configurations. Those configurations are held by pressure springs of the tilting clamp mechanisms in a transmission position in which a doctor blade functioning as the cleaning tool contacts a cylinder that must be cleaned, after a dead position of the transmission is overshot. A trough carrying the doctor blades can only be removed from the printing machine, for instance in order to clean the trough, together with the tilting clamp mechanisms that are attached to the trough. Since the connection of the trough and the tilting clamp mechanisms cannot be undone without a tool, it is difficult to handle the trough and the doctor blade during their removal and cleaning.

German Published, Non-Prosecuted Patent Application DE 43 28 834 A1 also describes a cleaning device having a swivel mechanism which does not have a dead position and which is therefore not a tilting clamp mechanism, but is rather what is known as a blocking clamp mechanism.

SUMMARY OF THE INVENTION

It is accordingly an object of the invention to provide a cleaning device in a printing machine and a printing machine with a cleaning device, which overcome the hereinafore-mentioned disadvantages of the heretofore-known devices of this general type and in which the cleaning device is easy to handle outside the printing machine.

With the foregoing and other objects in view there is provided, in accordance with the invention, a cleaning device for a printing machine, comprising a cleaning tool. A tilting clamp mechanism is provided for holding the cleaning tool in different positions. A coupling device is provided for coupling and uncoupling the cleaning tool and the tilting clamp mechanism to one another.

The coupling device makes it possible to detach the cleaning tool from the tilting clamp mechanism, so that the cleaning tool can be removed from the printing machine for maintenance without the tilting clamp mechanism. Following maintenance, the cleaning tool can be inserted into the printing machine again and drivingly connected to the tilting clamp mechanism by way of the coupling device. It is particularly advantageous that the cleaning tool can be detached without a tool by pulling the cleaning tool out of or away from the tilting mechanism, and that the cleaning tool can also be connected without a tool by placing the cleaning tool in or on the tilting clamp mechanism. In this type of realization of the coupling device as a plug connection, there is no need to loosen screws or the like, and therefore the cleaning tool can be coupled and decoupled very quickly.

In accordance with another feature of the invention, the tilting clamp mechanism includes a spring. The tilting clamp mechanism is arbitrarily movable into a lower position in which the spring holds the cleaning tool at a distance from a surface to be cleaned, and an upper position in which the spring holds the cleaning tool at the surface to be cleaned.

In accordance with a further feature of the invention, the surface to be cleaned is a circumferential surface of a cylinder.

In accordance with an added feature of the invention, the tilting clamp mechanism includes a rod about which the spring is wound like a screw.

In accordance with an additional feature of the invention, the tilting clamp mechanism is secured at a printing machine frame. It therefore remains disposed in the printing machine when the cleaning tool is removed from the printing machine.

In accordance with yet another feature of the invention, there is provided a trough. The cleaning tool is a blade secured at the trough. In accordance with yet a further feature of the invention, the tilting clamp mechanism has a journal. The coupling device is a coupling having a first coupling half disposed at the trough and a second coupling half disposed at the journal. In accordance with yet an added feature of the invention, the second coupling half is a groove formed in the journal, and the first coupling half is a profiled pin disposed at the trough and form-lockingly fitted in the groove. In accordance with yet an additional feature of the invention, the tilting clamp mechanism is one of two tilting clamp mechanisms. The trough is a torsionally-rigid synchronous shaft drivingly interconnecting the tilting clamp mechanisms for synchronous adjustment of the tilting clamp mechanisms.

With the objects of the invention in view, there is also provided a printing machine, comprising a cleaning device according to the invention.

Other features which are considered as characteristic for the invention are set forth in the appended claims.

Although the invention is illustrated and described herein as embodied in a cleaning device in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
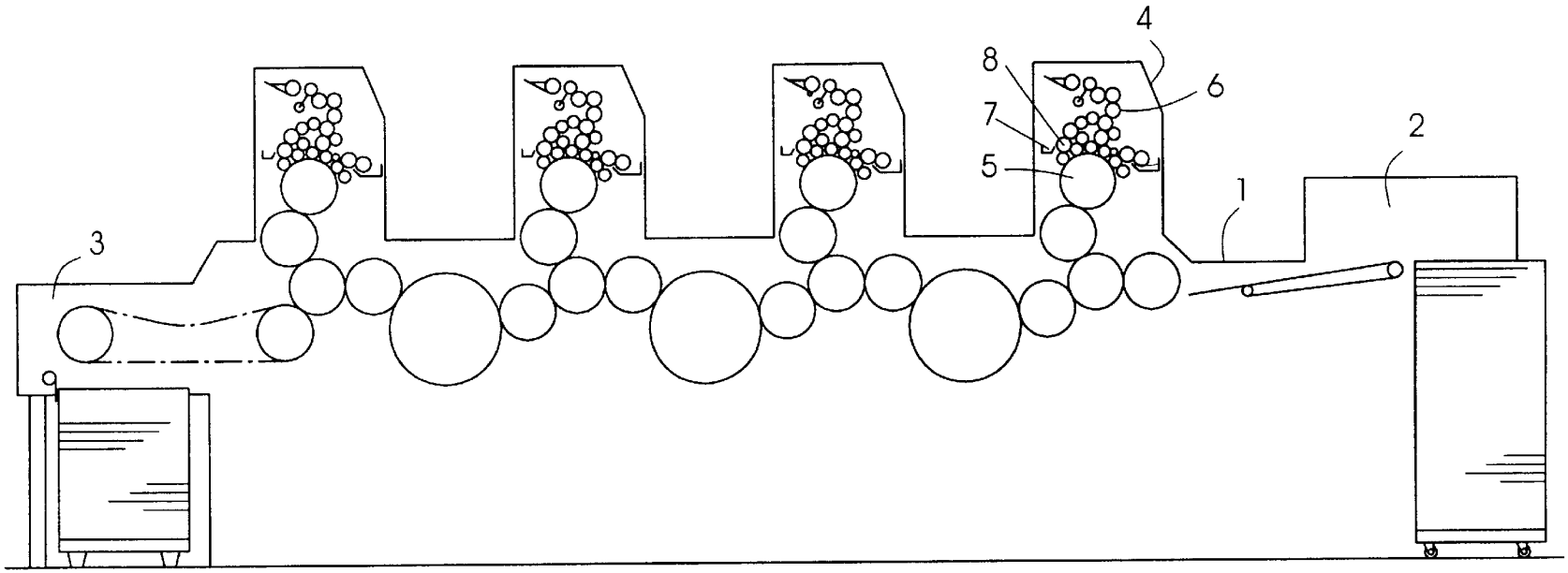
FIG. 1 is a side-elevational view of a printing machine with a cylinder and a cleaning device that is allocated thereto.

Referring now to the figures of the drawings in detail and first, particularly, to FIG. 1 thereof, there is seen a printing machine 1 which has a sheet feeder 2 and a sheet delivery 3 and which is constructed as a rotary printing machine. The printing machine includes at least one printing unit 4 which is realized as an offset printing unit that contains a printing form cylinder 5 and an inking unit 6 composed of cylinders, for inking the printing form cylinder. The printing machine 1 includes a cleaning device 7, which is associated with an axially changing cylinder (distributor cylinder) 8 of the inking unit 6 for the purpose of cleaning the same.

Figure 2:
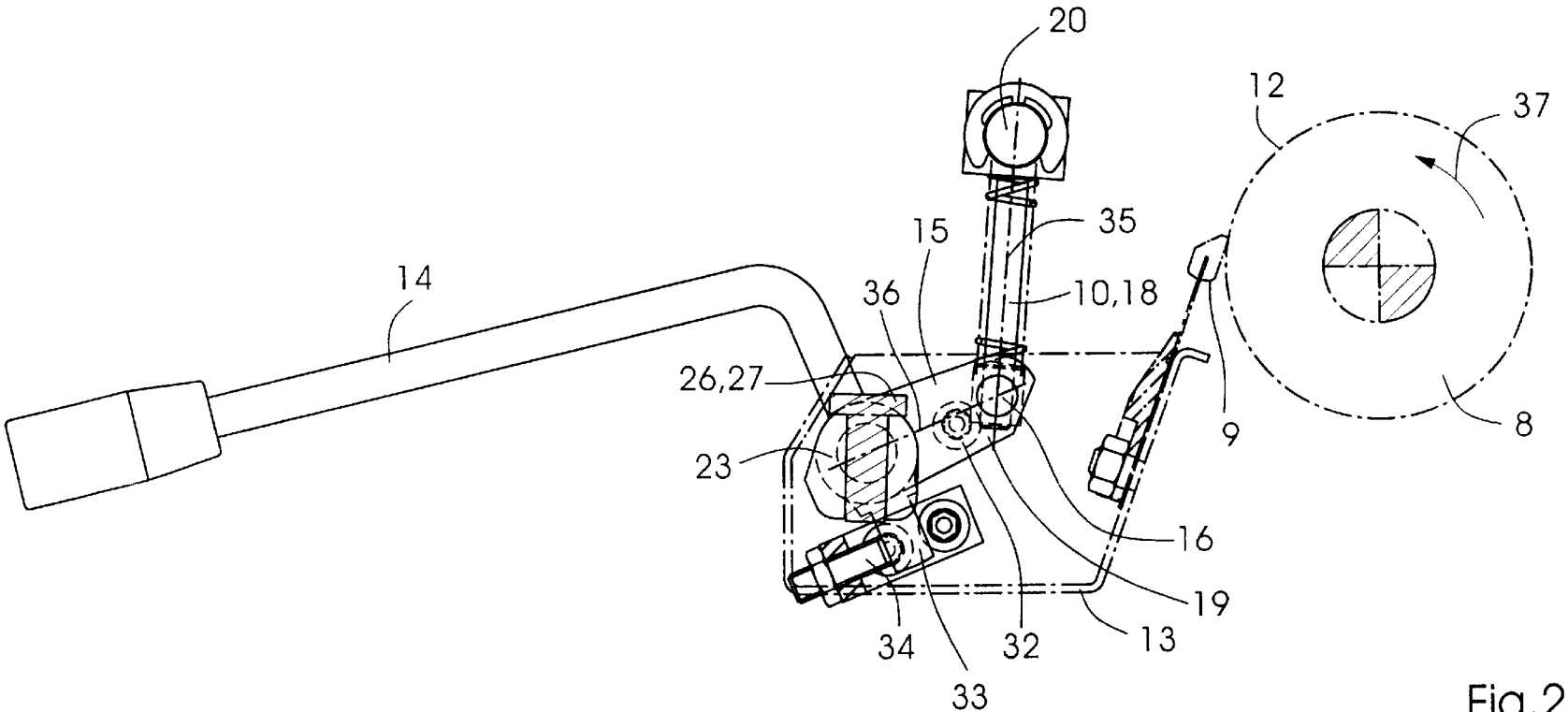
FIG. 2 is an enlarged, partly-sectional view of a cleaning device in a cleaning position (active position), which is taken along a section line II—II of FIG. 4, in the direction of the arrows.
Figure 3:
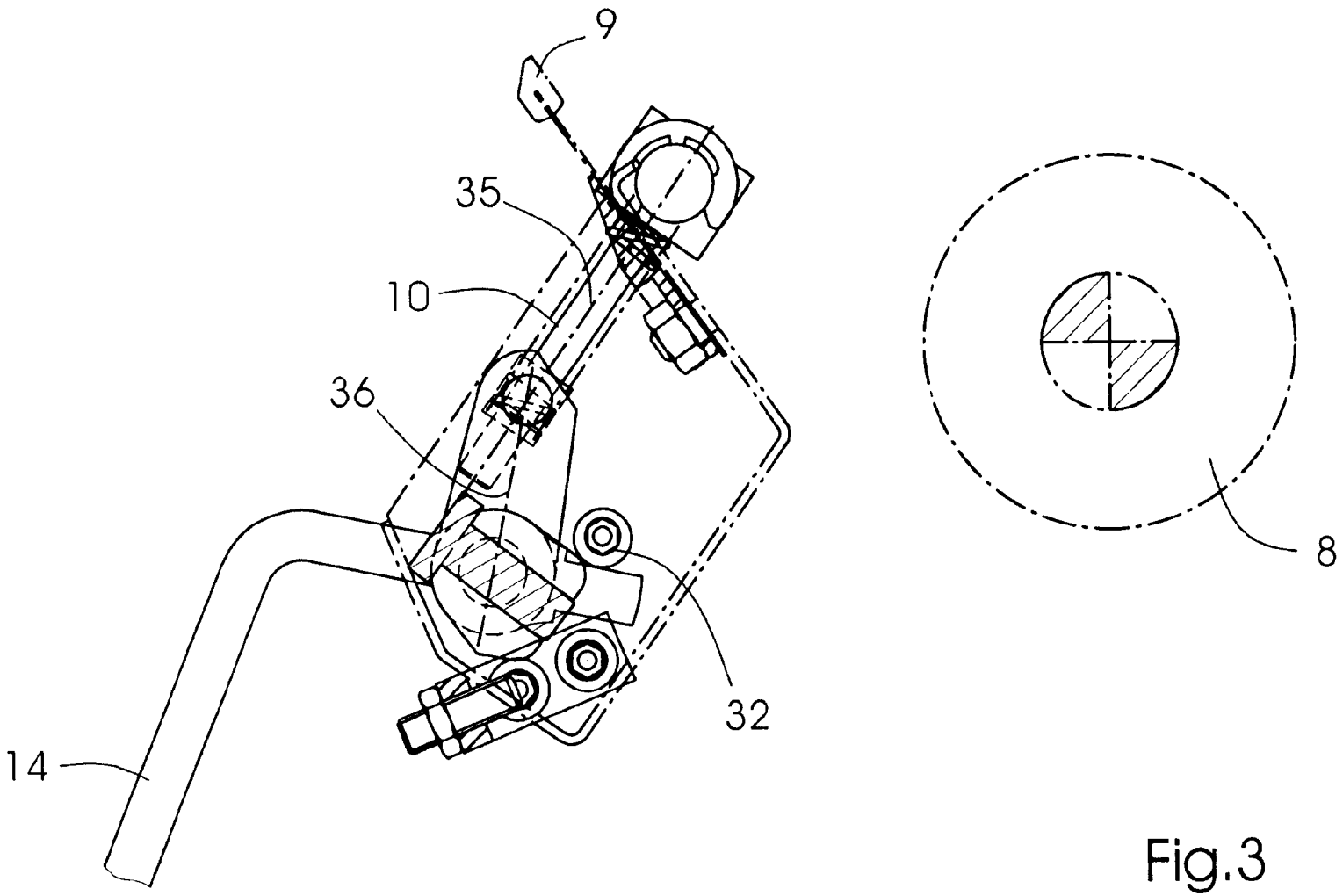
FIG. 3 is a view similar to FIG. 2, illustrating the cleaning device in a waiting position (passive position)

The cleaning device 7 includes a cleaning tool 9 which, depending on a setting of the tool 9, is held by tilting clamp mechanisms 10 and 11 in contact with a surface 12 on the periphery of the cylinder 8 that must be cleaned as seen in FIG. 2, or at a distanced from the surface 12 as seen in FIG. 3. The cleaning tool 9 is a doctor blade that is constructed as a rubber lip attached to a trough 13 for catching washing fluid and ink as they are removed from the surface 12.

Figure 4:
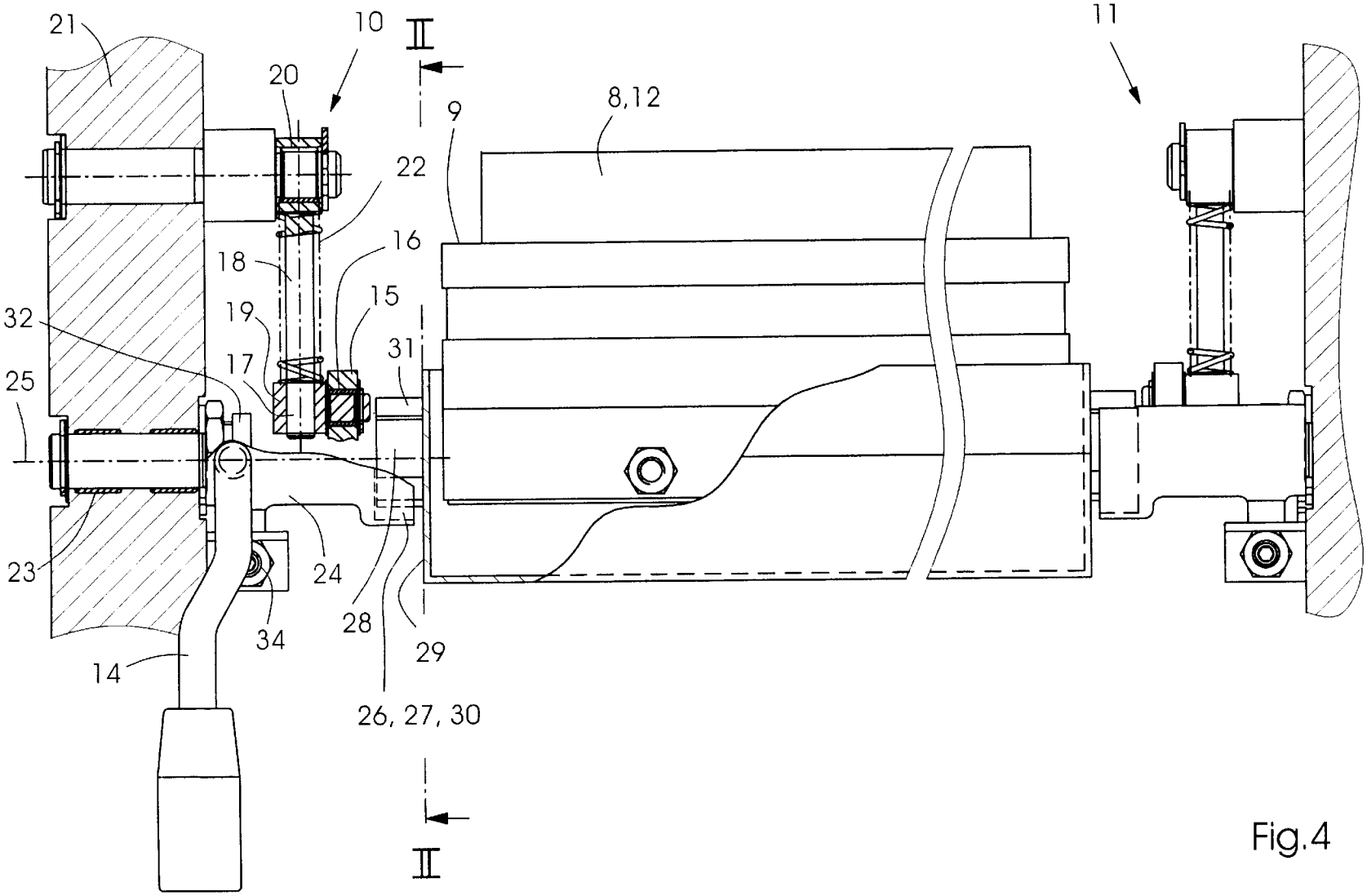
FIG. 4 is a side-elevational view of the cleaning device of FIG. 2, in the cleaning position.

The tilting clamp mechanism 10 is distinguished from the tilting clamp mechanism 11 only by the presence of an angled operating lever 14 which serves as a handle. An additional operating lever is not required for the tilting clamp mechanism 11. A torque applied by the operator to the tilting clamp mechanism 10 by using the operating lever 14 is transferred to the tilting clamp mechanism 11 exclusively by the trough 13 itself and without any additional synchronous shaft. Therefore, the two tilting clamp mechanisms 10 and 11 can be adjusted arbitrarily and synchronously with one hand into a down position (lower dead position: see FIG. 3) and an up position (upper dead position: see FIG. 2). The trough 13, which itself functions as a synchronous shaft, has a sufficiently torsionally resistant profile to transfer the torque. Since there is no additional synchronous shaft, and the tilting clamp mechanisms 10 and 11 are disposed close to sidewalls of a frame 21 of the printing machine as seen in FIG. 4, the inking unit 6 is easy to access.

The structure of the two tilting clamp mechanisms 10 and 11, which are constructed completely symmetrical to each other except for the operating lever 14 that is absent from the tilting clamp mechanism 11, will now be described by way of an example of the tilting clamp mechanism 10.

The tilting clamp mechanism 10 is formed of a lever 15 that functions as a drive rocker. The lever 15 is connected to a rod 18 in an articulated manner by way of a rotary joint 16 and a thrust linkage or prismatic joint 17. In order to form the rotary joint 16, a guide pin 19 is inserted into the lever 15 in a rotating manner, and in order to form the thrust linkage 17, the rod 18 is inserted into the guide pin 19 transversely. The rod 18 is coupled to the frame 21 of the printing machine 1 through the use of an additional rotary joint 20, which is stationary. The rotary joint 20 is formed by a journal or trunion on which the rod 18 is placed in such a way that it can be rotated.

A screw-type spring or pressure spring 22 which is held under a prestress is placed on the rod 18. One end of the spring 22 is led through the rod 18 and abuts the rotary joint 20, specifically at an eye of the rod 18. Another end of the spring 22 abuts the thrust linkage 17, namely at a flattening of the guide pin 19. The lever 15 is coupled to the frame 21 by way of a rotary joint 23. To that end, the lever 15 is connected in a torsionally resistant manner to a journal 24 functioning as a shaft. The journal 24 is mounted in the frame 21 in such a way that it rotates about an axis 25 through the use of the rotary joint 23.

A coupling device 26 connects the cleaning tool or blade 9 and the trough 13 to the tilting clamp mechanism 10 in such a way that they can be detached without a tool. The coupling device 26 is constructed as a coupling formed of a first coupling half 27 and a second coupling half 28. When the cleaning tool 9 along with the trough 13 are inserted into the printing machine 1, the coupling device 26 makes it possible to suspend the cleaning tool 9 and the trough 13 in the tilting clamp mechanism 10. After the coupling device 26 is closed, that is following the suspension of the trough 13, the coupling halves 27 and 28 are situated coaxially relative to each other, which permits a common twisting of the coupling halves 27 and 28 about the axis 25 that is predetermined by the rotary joint 23.

The first coupling half 27 is realized as a profiled pin which is attached to a sidewall 29 of the trough 13 and which can have a T-shaped profile, an L-shaped profile, or some similarly hook-shaped profile. The second coupling half 28 is realized as a radial groove which is formed in a planar surface of the journal 24, into which a leg 30 of the first coupling half 27 is precisely inserted given a closed coupling mechanism 26. Another leg 31 of the coupling half 27, which is bent away from leg 30, lays on the journal 24 peripherally from above. This construction prevents the first coupling half (profiled pin) 27 from slipping in the second coupling half (groove) 28 in either the lower (see FIG. 3) or the upper (see FIG. 2) position of the tilting clamp mechanism 10. Instead of the one-piece construction represented herein, a two-piece construction of the first coupling half (profiled pin) 27, wherein the legs 30 and 31 are connected to each other and the leg 31 is inserted into the leg 30 or screwed in transversely, is also conceivable.

The lower position of the tilting clamp mechanism 11, and thus the passive position of the cleaning tool 9, is determined by an adjustable stop 32 that is secured at the frame 21. The stop 32 is constructed as an eccentric bolt that is screwed into the frame 21 and that can be fixed in its set rotational position through the use of a contour nut. The stop 32, which limits the rotational angle of the journal 24, is advantageously adjustable with respect to an orientation of the second coupling half (groove) 28 relative to an identically constructed coupling half (groove) of a coupling device of the tilting clamp mechanism 11. Given coupling halves (grooves) of the tilting clamp mechanisms 10 and 11 that are oriented at the same angle of rotation, and therefore parallel to one another, when the tilting clamp mechanisms are situated in the lower position, the first coupling half (profiled pin) 27 and an identical coupling half (profiled pin) which is attached to the opposite end of the trough 13 can be inserted into the coupling halves (grooves) which are secured at the frame 21 with a tight fit and nevertheless smoothly, i.e. without being skewed. Therefore, a relatively slight eccentricity of the stop 32 suffices, which is provided by a circumferential rounding of a screw head of the stop 32 that is eccentric relative to a rotational axis of the stop 32. When the tilting clamp mechanism 10 is in the lower position, one side of a cam-shaped projection 33 of the journal 24 abuts the stop 32 due to stressing by the spring 22.

When the tilting clamp mechanism 10 is in the upper position, another side of the projection 33 abuts a stop 34, which is likewise constructed as a screw that is secured in its rotational position by a contour nut. The stop is secured at the frame 21 by an angle piece into which the stop 34 is screwed. A rotational axis of the stop 34 is oriented at a right angle to a rotational axis of the cylinder 8 and to the rotational axis 25. The projection 33 does not abut a circumferential surface of the stop 34 but rather its end surface, under the load produced by the spring 22.

An intensity of pressing the cleaning tool 9 against the surface 12 can be varied in dependence upon a set direction of the stop 34. The pressure can be increased by back-setting so as to compensate metal-to-metal wearing of the cleaning tool 9, and the pressure can be reduced in order to minimize the wearing of the cleaning tool. Additionally, the stop 34 which predetermines the rotational angle of the journal 24 serves together with a corresponding stop of the tilting clamp mechanism 11 to orient the cleaning tool 9 in a precise parallel position relative to the surface 12. This is done so that production imprecisions are compensated for and the pressing of the cleaning tool 9 against the surface 12 is uniform over the entire length of the cleaning tool 9.

The tilting clamp mechanism 10 is a spring-loaded transmission, in which the spring 22 generates what is known as a contact force. As is typical of tilting clamp transmissions, a change in the direction of the contact force (spring force) when the dead position (tilt position) of the mechanism is overshot is utilized for the purpose of holding the tilting clamp mechanism 19 either in a position under dead position (lower position) or in a position over dead position (upper position) as desired, using the contact force. The respective blocking position, i.e. the lower or upper position, must always surpass the dead position somewhat. Each of the stops 32 and 34 serves to fix the tilting clamp mechanism 10 precisely in one of the two blocking positions. The tilting clamp mechanism 10 is located in the dead position (tilt position) when a connecting center 35 of the rotary joints 16 and 20, which runs though the center axes of the rotary joints 16 and 20, frames flush with a connecting center 36 of the rotary joints 16 and 23. Since a knee that is formed by the lever 15, the rotary joint 16, and the rod 18 is fully extended in the dead position, the dead position is also referred to as the extended position. However, there are also suitable tilting clamp mechanisms in which the dead position is not an extended position but rather a coincidence position, in which two transmission members engage precisely.

A textbook entitled "Konstruktionselemente der Feinmechanik" [Structural Elements of Precision Mechanics] (ISBN 3-446-15332-2, Carl Hanser Verlag, Munich, Germany; Vienna, Austria 1989, Publisher: Werner Krause) contains comprehensive descriptions of tilting clamp mechanisms and their characteristics on pages 523 and 524. The tilting clamp mechanism 10 is closely related to a tilting jump mechanism (over-center-device).

The cleaning device 7 functions as follows:

Initially, the cleaning tool 9 and the trough 13 that is connected thereto are inserted into the printing machine 1 through an opening between sidewalls thereof that form the frame 21. During insertion, the tilting clamp mechanism 10 is situated in the position illustrated in FIG. 3, and the first coupling half 27 is form-lockingly connected to the second coupling half 28. In other words, the profiled pins that are disposed at the trough 13 are inserted into the grooves extending transverse to the respective journal 24 until the leg 31 contacts the journal 24. A form-locking connection is one which connects two elements together due to the shape of the elements themselves, as opposed to a force-locking connection, which locks the elements together by force external to the elements.

Subsequent to this coupling of the cleaning tool 9, the cylinder 8 and the surface 12 are driven in a direction of rotation 37 (see FIG. 2) by a motor of the printing machine 1, for instance in order to print with the printing unit 4. In order to remove the ink that remains in the inking unit 6 following the printing process from the same, a cleaning fluid is placed in the inking unit 6 through the use of a feed device, which is not illustrated in detail.

After this cleaning fluid has spread on the cylinders of the inking unit 6 and has sufficiently diluted and loosened the ink on these cylinders, the handle, i.e. the operating lever 14, is pivoted about the axis 25 in the clockwise direction with reference to FIG. 3. Thus, the journal 24 that is form-lockingly connected to the operating lever 14 is likewise rotated about the axis 25 in the clockwise direction, and the projection 33 lifts from the stop 32. The rotational motion of the journal 24 is transferred by way of the coupling device 26 to the trough 13 and the cleaning tool 9.

As a result of the rotational motion, the lever 15 that is secured to the journal 24 rotates together with the journal 24. Therefore, the guide pin 19 presses on the spring 22 in such a way that it is further compressed and its pretension rises. By way of the joints 16 and 17, the rotational motion of the lever 15 is transferred to the rod 18, which thus rotates counterclockwise about the joint 20. In the course of the rotational movements, the rod 18 pushes further and further along the thrust linkage through the guide pins 19, namely until the tilting clamp mechanism 10 reaches its dead position, in which the connection centers 35 and 36 lie along a straight line. When the tilting clamp mechanism 10 is in the dead position, the spring 22 has reached its maximum compression.

Given additional rotation of the operating lever 14 in the clockwise direction, the dead position is overshot, the rod 18 is withdrawn back into the thrust linkage 17, and the spring 22 expands again. Given an overshooting of the dead position, there is a change in the direction of the spring force, or the contact force, of the spring 22, which has a force action line that coincides with the connecting center 35. Before the dead position is overshot, the spring 22 generates a left-rotational (counter-clockwise) torque of the lever 15 about the axis 25, and after the dead position is overshot, it generates a right-rotational (clockwise) torque of the lever 15 about the axis 25. The operating lever 14 is rotated further in the clockwise direction until the projection 33 contacts the stop 34. When the cleaning device 7 has assumed this cleaning position, the cleaning tool 9 contacts the surface 12 with the required pressure, which has been preset through the use of the stop 34. The projection 33 is held securely at the stop 34 by the spring 22.

During the cleaning, the cleaning tool 9 scrapes the ink, cleaning fluid and contaminants that are trapped by the trough 13 from the surface 12. By virtue of the selected configuration, a friction force that is exerted on a washup blade edge by the surface 12 effectuates a self-reinforcing pressing force of the cleaning tool 9 against the surface 12. Stick-slip effects are prevented by the steep incline of the cleaning tool relative to the surface 12. The dirty fluid that is trapped in the trough 13 can drain from the trough 13 into a waste disposal device by way of a drain which is not represented herein.

Following the cleaning process, the cleaning tool 9 is removed from the surface 12 by pivoting the operating lever 14 counterclockwise about the axis 25 into its original position again as represented in FIG. 3. The transmission movements that occur in the tilting clamp mechanism 10 during this process are the opposite of the transmission movements described in connection with the setup of the cleaning tool 9 and therefore do not require further explanation. The removal motion of the cleaning tool 9 ends with the stopping of the projection 33 at the stop 32. When the tilting clamp mechanism 10 is in the passive position again with the projection 33 standing at the stop 32, the spring 22 remains under a certain prestress, so that this stress keeps the tilting clamp mechanism 10 in the passive position and the projection 33 at the stop 32.

The cleaning tool 9 can be accessed easily in the passive position (see FIG. 3), given that a pivot angle of the cleaning tool 9 between the active position and the passive position is greater than 30°, and preferably greater than 45° (e.g. approximately 55°). Thus, by pivoting the cleaning tool 9 about the axis 25 beyond this angle, it can be withdrawn far enough from the surface 12 that contaminants which adhere to the cleaning tool 9 can be washed off easily in the passive position even when the cleaning tool 9 is situated in the printing machine 1. After the rotation of the cylinder 8 is stopped, the trough 13 can be decoupled from the tilting clamp mechanism 10 and removed again from the printing machine 1 in order to clean it.

In conclusion, it is noted that a motorized and thus remote controllable setting of the tilting clamp mechanism 10 and 11 is conceivable. All that is required for this is to connect the tilting clamp mechanism 10 to an actuator, for instance a pneumatic actuator cylinder, for the common driving thereof.

We claim:

1. A cleaning device for a printing machine with a printing machine frame, the cleaning device comprising:

a trough with a cleaning tool;

a tilting over-center-mechanism for holding said cleaning tool in different positions, said tilting over-center-mechanism having a dead position;

a coupling device for coupling and uncoupling said trough and said tilting over-center-mechanism to one another; and said tilting over-center-mechanism secured at the printing machine frame for remaining disposed in the printing machine upon removing said trough and said cleaning tool from the printing machine after uncoupling said trough from said tilting over-center-mechanism by said coupling device.

2. The cleaning device according to claim 1, wherein said tilting over-center-mechanism includes a spring, and said tilting over-center-mechanism is arbitrarily movable into a lower position in which said spring holds said cleaning tool at a distance from a surface to be cleaned, and an upper position in which said spring holds said cleaning tool at the surface to be cleaned.

3. The cleaning device according to claim 2, wherein the surface to be cleaned is a circumferential surface of a cylinder.

4. The cleaning device according to claim 2, wherein said tilting over-center-mechanism includes a rod about which said spring is wound like a screw.

5. The cleaning device according to claim 1, wherein said cleaning tool is a blade secured at said trough.

6. The cleaning device according to claim 5, wherein said tilting over-center-mechanism has a journal, and said coupling device is a coupling having a first coupling half disposed at said trough and a second coupling half disposed at said journal.

7. The cleaning device according to claim 6, wherein said second coupling half is a groove formed in said journal, and said first coupling half is a profiled pin disposed at said trough and form-lockingly fitted in said groove.

8. The cleaning device according to claim 5, wherein said tilting over-center-mechanism is one of two tilting over-center-mechanisms, and said trough is a torsionally-rigid synchronous shaft drivingly interconnecting said tilting over-center-mechanisms for synchronous adjustment of said tilting over-center-mechanisms.

9. In a printing machine with a printing machine frame, a cleaning device comprising:

a trough with a cleaning tool;

a tilting over-center-mechanism for holding said cleaning tool in different positions, said tilting over-center-mechanism having a dead position and a spring generating a spring force, said spring being mounted via a rotary joint for overshooting said dead position and thereby changing a direction of said spring force;

a coupling device for coupling and uncoupling said trough and said tilting over-center-mechanism to one another; and said tilting over-center-mechanism secured at the printing machine frame for remaining disposed in the printing machine upon removing said trough and said cleaning tool from the printing machine after uncoupling said trough from said tilting over-center-mechanism by said coupling device.

* * * * *